US005395109A

United States Patent [19]

Fenton, Jr.

[11] Patent Number: 5,395,109

[45] Date of Patent: Mar. 7, 1995

[54] GOLF CLUB HOSEL HAVING DEPRESSIONS FORMED THEREIN

[75] Inventor: Francis A. Fenton, Jr., Sarasota, Fla.

[73] Assignee: Fenton Golf, Inc., Sarasota, Fla.

[21] Appl. No.: 264,529

[22] Filed: Jun. 23, 1994

Related U.S. Application Data

[63] Continuation-in-part of Ser. No. 67,697, May 26, 1993, Pat. No. 5,324,033.

[51] Int. Cl.[6] ..... A63B 53/02

[52] U.S. Cl. ..... 273/80.2; 273/80.3; 273/167 E; 273/167 F; 273/169

[58] Field of Search ..... 273/80.1, 80.2, 80.3, 273/80.4, 80.5, 80.6, 80.7, 80.8, 80.9, 77 R, 167 R, 167 E, 169, 167 F

[56] References Cited

U.S. PATENT DOCUMENTS

| | | | |
|---|---|---|---|
| D. 125,455 | 2/1941 | Newsome . | |
| D. 247,824 | 5/1978 | Meissler . | |
| 1,266,529 | 5/1918 | Mattern . | |
| 1,396,470 | 11/1921 | Taylor . | |
| 1,695,291 | 12/1928 | Muller . | |
| 1,778,122 | 10/1930 | Pedersen . | |
| 1,892,482 | 12/1932 | Cash, Jr. . | |
| 1,985,427 | 12/1934 | Richardson . | |
| 3,582,081 | 6/1971 | Caplan . | |
| 4,065,133 | 12/1977 | Gordos . | |
| 4,555,112 | 11/1985 | Masghati | 273/80 B |
| 5,324,033 | 6/1994 | Fenton | 273/80.2 |

FOREIGN PATENT DOCUMENTS

| | | |
|---|---|---|
| 210073 | 8/1957 | Australia . |
| 5076105 | 1/1977 | Japan . |
| 322635 | 12/1929 | United Kingdom . |
| 371974 | 5/1932 | United Kingdom . |
| 1078412 | 8/1967 | United Kingdom . |
| 2012597A | 8/1979 | United Kingdom . |

*Primary Examiner*—Sebastiano Passaniti
*Attorney, Agent, or Firm*—Richard H. Kosakowski

[57] ABSTRACT

A golf club has a clubhead with a neck portion or hosel integrally formed therewith. The hosel has a generally cylindrical shape with a corresponding cylindrical concentric bore hole formed in a portion of the hosel. One or more depressions of a predetermined shape are formed in the outer surface of the hosel wall material by selectively removing portions of the hosel wall material. The depressions are formed to a depth that does not penetrate the entire thickness of the hosel wall material. This leaves the entire inner surface of the hosel wall material available for adhesion to a golf club shaft inserted into the hosel bore hole. The depressions may take various shapes, and may be disposed at predetermined locations around the circumference of the outer surface of the hosel wall material.

18 Claims, 3 Drawing Sheets

GOLF CLUB HOSEL HAVING DEPRESSIONS FORMED THEREIN

RELATED APPLICATION

This is a continuation-in-part of pending application Ser. No. 08/067697, filed May 26, 1993, now U.S. Pat. No. 5,324,033.

BACKGROUND OF THE INVENTION

This invention relates to golf clubs, and more particularly, to a golf club having a neck portion or "hosel" that has selected portions of the hosel outer wall material removed, resulting in a plurality of depressions formed in the hosel wall.

In the golf club art, it is known to form a clubhead with an integral hosel or neck portion. The hosel has an internal bore hole that may extend either the entire length of the hosel (i.e., a "throughbore"), or only a portion of the hosel (i.e., a "blind bore"). The hosel is formed at an angle with respect to the bottom, or "sole" of the clubhead. This angle is referred to as the "lie" of the club. The hosel bore hole receives an end portion of the shaft of the golf club. Often times, both the hosel bore hole and the end of the shaft are tapered somewhat. The shaft is secured to the clubhead within the hosel by means such as pins or adhesives. It is critical that the means employed in securing the shaft to the clubhead within the hosel be of high integrity to withstand relatively large torsional strains placed thereon due to the impact of the golf ball with the clubhead, which extends laterally out from the vertical axis of the shaft.

In the early part of the twentieth century, golf clubs were constructed with metal heads and wooden shafts. The wooden shafts were secured within bores in the hosels of the clubheads by adhesives, and often times reinforced by one or more transverse pins. Relative to modern-day hosels, these early hosels were much longer in order to provide a satisfactory joint between the shaft and head. The early hosels also had a much larger outside diameter because wooden shafts had a significantly larger diameter than modern-day metal or composite shafts. In the early hosels, holes were drilled clear through the hosel material to facilitate placement of pins into or through the wooden shaft. Further, slots were formed clear through the hosel on the premise that the wooden shaft would swell over time into the slots, thereby helping to secure the shaft to the hosel. See, for example, U.S. Pat. No. 1,266,529 to Mattern.

These early hosels also oftentimes had horizontal or spiral rings or grooves formed in the hosel outer surface. These grooves, or "knurlings" were formed continuously around the hosel outer surface and were made by compressing the hosel material inward toward the shaft, often by forging. This put pressure on the wooden shaft to aid in securing the shaft within the hosel. Over time, the knurlings also took on an ornamental or decorative look and purpose. It is to be noted, however, that these knurlings merely redistributed the hosel material or mass by compressing it inward toward the shaft, and did not remove the mass. It has long been recognized that the hosel represents an undesirable weight or mass placement on the clubhead. This is why modern clubheads have hosels that are relatively smaller in diameter and shorter in length as compared to the prior art.

The horizontal grooves in the early hosels, whether serving an ornamental or functional purpose or both, tended to weaken the hosel material. Over time under the repeated stress of impact of the clubhead with the ball and turf, the grooves caused a localized area of stress (i.e., a "stress riser"). This prompted the hosel and/or the shaft to catastrophically fail by fracturing at the junction of the shaft and hosel.

The early hosels also often had compressed vertical depressions formed in the shape of "nicks" at the top of the hosel. These nicks helped to secure the shaft to the clubhead, similar to the horizontal grooves. See the aforementioned U.S. Pat. No. 1,266,529 to Mattern.

The early prior art recognized the problem with the relatively large and long hosels. One known attempt to reduce the size and weight of the hosel is described in British Patent Specification No. 371974 to Renwick. Therein, it was taught to taper the hosel diameter in a decreasing amount toward the top of the hosel. The stated purpose was to make the hosel progressively weaker and lighter, thereby transferring the impact forces gradually to the shaft. The premise was that the tapered portion would flex somewhat, to help prevent fracture. Also, abrupt cross-sectional diameter dimensional changes would be avoided, thereby reducing stress points.

Additional problems with these early hosels were that the holes in the hosel allowed the adhesive to seep out of the hosel and further allow moisture to invade the wooden shaft, thereby degrading the integrity of the connection. Also, the wooden shaft tended to dry out and shrink in warmer temperatures, creating a loose fit of the shaft within the hosel. The loose fit permitted a large amount of torsional forces at impact of the clubhead with the ball to be absorbed by the pin. Over time, this caused cracks in the shaft.

Later, when metal shafts were developed, it was still known to pin the shaft to the hosel. It was further known to form slots clear through the hosel material to provide resiliency to the aforementioned torsional force at impact of the clubhead with the golf ball. The slots were formed on the hosel below the point where the pin was located. See, for example, U.S. Pat. No. 1892482 to Cash, Jr. As taught in this patent, the shaft was not fixedly attached to the hosel below the pin. Instead, the shaft was allowed to swivel to a limited extent with respect to the hosel. In such a connection, the pin absorbed the major portion of the torsional force at impact of the clubhead with the ball.

Alternatively, it is known in the more modern art to design a clubhead with no hosel whatsoever. This is true for clubs of the "metal-wood" type. The no-hosel design entirely removes the weight of the hosel and allows the weight to instead be placed in the clubhead, where it may be more desirable and beneficial.

The no-hosel design is not without its drawbacks, however. Eliminating the hosel largely reduces the amount of area available inside the clubhead for bonding to the outside of the shaft. This causes problems over time due to the aforementioned torsional strain placed on the interface of the clubhead with the shaft. In the no-hosel design, this large amount of torsional strain is distributed along a much smaller amount of the tip of the shaft. Such large amount of strain may exceed the strength of materials used on some composite shafts.

Another problem with the no-hosel design lies in the fact that a different sensation, or "feel", is experienced by the golfer when the club is swung. In other words, the golfer tends to perceive that the balance of the club is "off" (i.e., is much different than what the golfer is accustomed to using with a traditional clubhead having a hosel).

A further problem with the no-hosel design is that the shaft of the club has lost some of its normal "kick" or spring. This is because the shaft designers attempt to build up the walls of the shaft, or they insert other materials in the tip of the shaft to protect the shaft from breaking off at the clubhead.

Accordingly, a primary object of the present invention is to provide a golf club having a head with an integral hosel or neck portion having an internal bore hole for receiving an end portion of a shaft, and having selected portions of the hosel wall material surrounding the bore hole removed to reduce the weight or mass at the hosel portion.

It is a general object of the present invention to simultaneously reduce the weight of a hosel and redistribute the weight to the remainder of the clubhead where it is more beneficial.

It is a further object of the present invention to provide a reduced-weight hosel with ample inner surface material to allow for proper adherence of the shaft within the hosel, thus allowing for proper and adequate support of the shaft within the hosel.

It is yet another object of the present invention to provide a hosel that allows a golf club manufacturer to use a normal golf club shaft that does not require the clubhead end of the shaft to be reinforced before the shaft is inserted into the hosel.

It is yet another object of the present invention to provide a hosel that provides for proper "feel" and "balance" of the golf club to a golfer as the club is swung.

The above and other objects and advantages of this invention will become more readily apparent when the following description is read in conjunction with the accompanying drawings.

SUMMARY OF THE INVENTION

To overcome the deficiencies of the prior art and to achieve the objects listed above, the Applicant has invented an improved, reduced weight hosel for a golf club having selected portions of the hosel outer wall material removed to form one or more depressions in the hosel wall material from the outer surface inward toward the center axis of the hosel. The Applicant has specified practical ranges for physical characteristics of the hosel, such as the outside diameter of the hosel, the inside diameter of a bore hole formed in the hosel, the resulting wall thickness of the hosel, the maximum depth of penetration of a depression into the hosel wall, the length of the hosel, the surface area of the hosel, the amount of coverage of the hosel surface area by a depression, and the width of a depression.

In the preferred embodiment, a golf club of the type of either an "iron", "metal wood" or "putter" has a clubhead with a neck portion or hosel integrally formed therewith. The hosel has a generally cylindrical shape with a corresponding cylindrical concentric bore hole formed in a portion of the hosel that results in a predetermined and uniformly thick amount of hosel wall material remaining that completely encircles the inner bore hole. One or more depressions of a predetermined shape are formed in the outer surface of the hosel wall material by selectively removing portions of the hosel wall material. The depressions are formed to a depth that does not penetrate the entire thickness of the hosel wall material. Thus, the entire inner surface of the hosel wall material is available for adhesion to the golf club shaft that is inserted into the hosel bore hole. The depressions may take on many different shapes, such as slots or dots, and may be disposed at predetermined locations around the circumference of the outer surface of the hosel wall material. The resulting portions of hosel wall material selectively removed represent an amount of mass or weight of the clubhead that may be distributed to other portions of the clubhead for more beneficial use.

In an alternative embodiment, the hosel has a first cylindrical portion that rises up from the clubhead. The depressions are formed in an outer surface of this first hosel portion. Integral with this first hosel portion and disposed thereabove is a second "male" hosel portion of a diameter that is smaller than that of the first portion. In contrast to the preferred embodiment, no bore hole is formed in either hosel portion in this alternative embodiment. Instead, the shaft of the golf club fits over the second "male" hosel portion and is secured thereto.

DETAILED DESCRIPTION OF THE PREFERRED EMBODIMENTS

Figure 1:
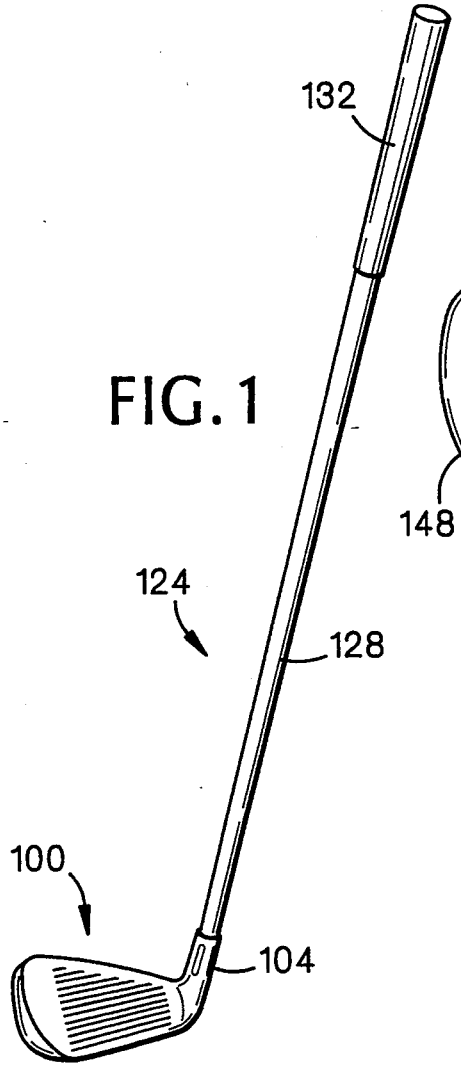
FIG. 1 is a perspective view of a golf club having a clubhead with a hosel formed according to the present invention.

Referring to the drawings in detail, an improved head for either an "iron", "wood" or "putter"-type of golf club is illustrated and generally designated by the reference number 100. Identical reference numbers are used to identify identical or similar elements or features described hereinafter on each type of club. The head 100 has a hosel portion 104 integrally formed therewith. The hosel 104 has a bore hole 108 formed in a portion of the hosel 104 which leaves a predetermined amount of hosel wall material 112 that completely encircles the inner bore hole 108. One or more depressions 116 of a predetermined shape, for example, slots or hemispheres (i e., "dots") are formed in the hosel wall material 112 by selectively removing portions of the hosel wall material 112 beginning from an outer surface 120 of the hosel wall 112 and extending inward toward the center of the hosel 104. The depressions 116 are formed to a depth that does not exceed the entire thickness of the hosel wall material 112.

Figure 2:
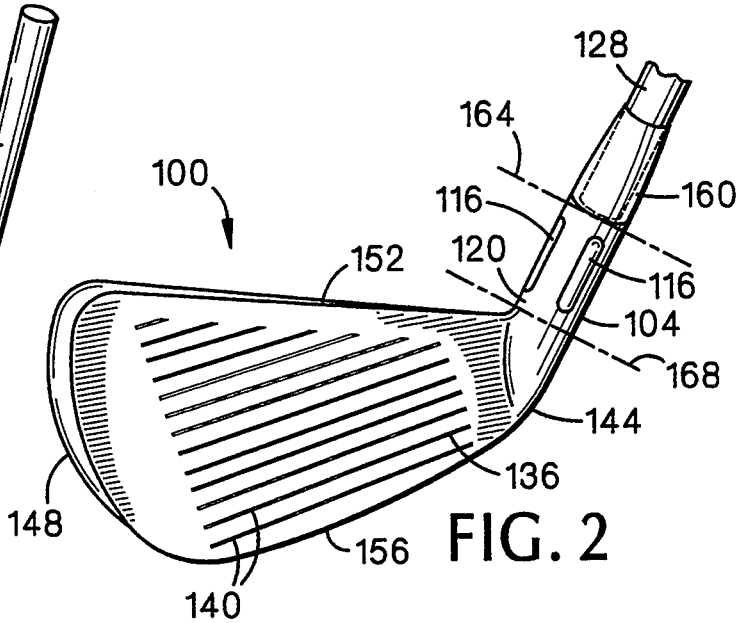
FIG. 2 is a close-up perspective view of the head portion of the golf club of FIG. 1.

FIG. 1 illustrates in perspective an "iron"-type golf club 124 having a clubhead 100, a shaft 128 and a grip 132. FIG. 2 illustrates in more detail the clubhead 100 of FIG. 1 having a striking face 136 for contacting a golf ball (not shown). The striking face 136 typically has a plurality of grooves 140 formed therein. The clubhead also comprises heel 144 and toe 148 portions, along with top 152 and sole 156 portions. At the point where the shaft 128 emerges from the top of the hosel 104, a ferrule 160 having a tapered outer surface is usually included.

Integrally formed with the clubhead 100 and rising from the heel 144 is the neck or hosel 104. The hosel 104 has a plurality of depressions 116 formed therein in accordance with the present invention. The hosel 104 may be generally cylindrical in shape throughout most, if not all, of its length. For the purposes of the present invention, the hosel length is defined as extending between the top of the hosel (as indicated by the upper phantom line 164 in FIGS. 2 and 3) and the approximate point (i.e., the "juncture" point, as indicated by the lower phantom line 168 in FIGS. 2 and 3) on the clubhead 100 near the heel 144 where the hosel 104 begins to lose its cylindrical shape and starts to "flare out" into a "web" shape to meet the generally planar face 136 of the clubhead 100. The hosel length is independent of the depth of the bore hole 108. Note that hosel length as defined herein is a general approximation. This is because there exists no exact defined juncture point 168 on the clubhead 100. Also, iron-type clubheads 100 vary somewhat in shape, and, thus, location of the "juncture" point 168, among manufacturers. This also leads to variance in hosel length. Further, there are differences in hosel length between irons, woods, and a putter in a set of golf clubs 124. However, the definition of hosel length given herein serves as an accurate and specific basis for the claims that follow hereinafter.

The hosel 104 has the inner bore hole 108 formed normally concentric to the cylindrical axis of the hosel 104. As seen in greater detail in FIG. 3, the bore hole 108 extends down a predetermined portion of the hosel 104 (i.e., a "blind bore"), and is operable to receive an end of the golf club shaft 128. Although not shown, in the alternative, the bore hole 108 may extend to the sole 156 of the clubhead 100 at the heel 144 (i.e., a "through-bore"). The head 100 may be formed by any one of a number of known methods, including without limitation, casting, forging, milling, molding, etc. In a preferred embodiment, the head 100, along with the depressions 116, are made by a known investment casting technique.

Figure 3:
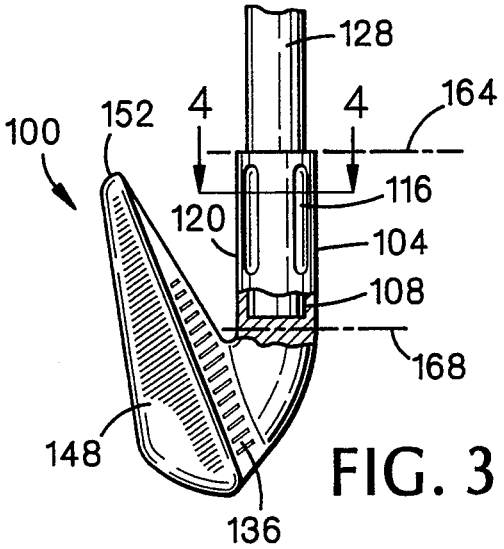
FIG. 3 is a toe-end view of the clubhead of FIG. 2 having slots formed in the hosel portion of the clubhead in accordance with the present invention.

Referring now to FIG. 3, there illustrated is a toe-end view of the iron-type of clubhead 100. The pair of depressions 116 visible in FIG. 3 are of a shape referred to as a "fluted slot". In an embodiment of the present invention, four fluted slots 116 are formed in the hosel wall 112 and spaced evenly around its circumference. However, it is not required for the broadest scope of the present invention that the plurality of depressions 116 be formed symmetrically around the hosel circumference; they may be non-symmetrical. Also, the broadest scope of the present invention contemplates only one depression 116 being formed in the hosel 104. However, if a plurality of separate depressions 116 are utilized, a symmetrical arrangement is recommended because it reduces stress points in the hosel material 112 that are inherent with a nonsymmetrical depression placement.

Figure 4:
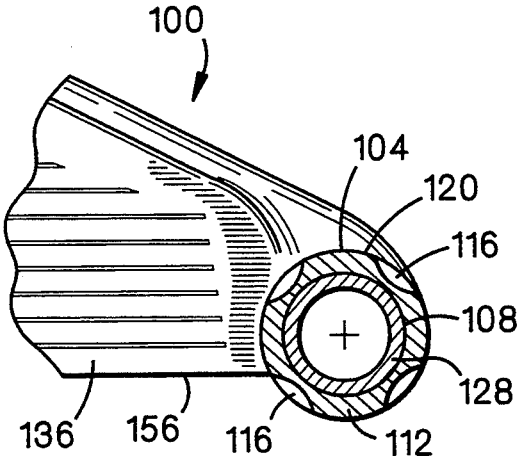
FIG. 4 is a cross-section view of the clubhead of FIG. 3 taken along the lines 4—4 of FIG. 3.

Referring also to FIG. 4, the hosel 104 illustrated therein is typical of a modern-day hosel 104 that is cylindrical in shape. As a practical matter given the physical limitations of various materials used along with factors that influence the "playability" of golf clubs, the chosen value of the outside diameter of the hosel 104 may be selected from the range of from 0.250 inches to 1.250 inches, with a typical value for a hosel outside diameter described herein in conjunction with a preferred, yet exemplary, embodiment being 0.500 inches. As illustrated, an inner bore hole 108 is formed in the hosel from the top 164 of the hosel 104 down to a predetermined depth (i.e., a "blind bore"). The bore hole 108 secures an end of the shaft 128 of the golf club 124 of FIG. 1 to the clubhead 100. In FIG. 4, the bore hole 108 is cylindrical and formed concentric to the hosel's cylindrical shape; i,e., the center axis of the bore hole 108 is aligned coaxially with the center axis of the hosel 104. Although shown in FIG. 3 as being of constant inside diameter, the bore hole 108 may be tapered, if desired. In a preferred embodiment, the depth of the bore hole 108 is approximately 1.125 inches; however, that depth is purely exemplary and its value has no bearing on the present invention.

The bore hole 108 has a chosen diameter that depends in part upon the outside diameter of the hosel 104 and also on the shaft diameter. For a hosel outside diameter of 0.250 inches, the inside diameter of the hosel bore hole 108 (i.e., the "hosel bore I.D.") may be constant and be chosen from the range of from a minimum of 0.200 inches to a maximum of 0.225 inches. For a hosel outside diameter of 1.250 inches, the hosel bore I.D. may, without limitation, be chosen from the range of from a minimum of 0.200 inches to a maximum of 0.700 inches. For the aforementioned typical hosel outside diameter of 0.500 inches, the hosel bore I.D. may range, without limitation, from a minimum of 0.277 inches to a maximum of 0.376 inches. However, these numbers are purely exemplary. The ranges from which a value for hosel outside diameter and hosel bore I.D. are chosen may be larger of smaller. Also, it is to be understood that the typical hosel outside diameter of 0.500 inches is also strictly exemplary. Further, the quantities given herein for hosel bore I.D. are equally applicable to tapered bore holes 108 as well.

Given the aforementioned numbers for hosel outside diameters and the inside diameter of the hosel bore 108, the resulting wall thicknesses of the hosel 104 range as follows: for a hosel outside diameter of 0.250 inches and a hosel bore I.D. that ranges from 0.200 inches to 0.225 inches, the resulting wall thickness ranges from a maximum of 0.025 inches to a minimum of 0.0125 inches. For a maximum hosel outside diameter of 1.250 inches and a hosel bore I.D. that ranges from a minimum of 0.200 inches to a maximum of 0.700 inches, the resulting wall thickness varies from a maximum of 0.525 inches down to a minimum of 0.275 inches. For a typical hosel outside diameter of 0.500 inches and a hosel bore I.D. that ranges from a minimum of 0.277 inches to a maximum Of 0.376 inches, the resulting wall thickness varies from a maximum of 0.1115 inches down to a minimum of 0.062 inches.

In an exemplary embodiment of the present invention, the fluted slots 116 are each formed with a length of 0.605 inches, and are spaced evenly on the hosel 104 from the top and bottom of the bore hole 108. However, it is to be understood that this is purely exemplary. Each fluted slot 116 does not have to be aligned vertically on the hosel 104. Further, each fluted slot 116 does not have to be spaced evenly from the top and bottom of the bore hole 108. However, with such even spacing of the fluted slots 116, and with a bore hole depth of 1.125 inches in an exemplary embodiment, the resulting top and bottom spacing for each fluted slot 116 is 0.260 inches.

In FIG. 4 (which is not drawn to scale), the shape of each fluted slot 116 in cross section, along with its position relative to the outer wall material 112 of the hosel 104, can be seen in greater detail. In a preferred embodiment of the present invention, each fluted slot 116 is circular in cross-section. The broadest scope of the present invention contemplates a range of depth of the depressions 116 (e.g., the fluted slots) from a minimum depth of at least ten percent of the thickness of hosel wall 112, to no more than 75 percent of the wall thickness. The depth of a depression 116 may be constant for that depression, or it may vary. In all instances, the depth of penetration of each depression 116 is defined to be the farthest distance that the depression achieves from the outer surface 120 of the hosel wall 112. In light of the foregoing numbers for hosel outside diameter, hosel bore I.D. and wall thickness, the hosel wall 112 achieves a maximum thickness of 0.525 inches for a hosel outside diameter of 1.250 inches and a hosel bore I.D. of 0.200 inches. On the other hand, the hosel wall 112 achieves its minimum thickness of 0.0125 inches for a hosel outside diameter of 0.250 inches and a hosel bore inside diameter of 0.225 inches.

In all of the exemplary embodiments described herein, the depressions 116 are formed to not penetrate the entire thickness of the hosel wall material 112. This is in sharp contrast to the aforementioned prior art wherein the depressions were formed clear through the wall material. By providing depressions 116 that do not penetrate the entire thickness of the hosel wall material 112, the present invention allows the tip of the shaft 128 to be properly supported within the bore hole 108.

With a maximum hosel outside diameter of 1.250 inches and a hosel bore I.D. of 0.200 inches, the resulting wall thickness is 0.525 inches. The resulting depth of each depression 116, within its preferred range of 10 percent to 75 percent, is 0.0525 inches to 0.3938 inches, respectively. The remaining thickness of the wall 112, as measured from the maximum depth of the depression 116 to the inner diameter of the hosel bore 108, is 0.4725 inches for the 10 percent depression depth of 0.0525 inches. The resulting wall thickness is 0.1312 inches for the 75 percent depth of penetration of 0.3938 inches.

With a hosel outside diameter of 1.250 inches and a hosel bore inside diameter of 0.700 inches, the resulting wall thickness is 0.275 inches. The ten percent depression depth is 0.0275 inches and the resulting wall thickness is 0.2475 inches. With a 75 percent depression depth of 0.2063 inches, the resulting wall thickness is 0.0687 inches.

With a typical hosel outside diameter of 0.500 inches, and a hosel bore inside diameter of 0.277 inches, the resulting wall thickness is 0.1115 inches. The ten percent depth of depression is 0.01115 inches with a resulting wall thickness of 0.1004 inches, With a 75 percent depth of depression of 0.0836 inches, the resulting wall thickness is 0.0279 inches.

With a typical hosel outside diameter of 0.500 inches and a hosel bore inside diameter of 0.376 inches, the resulting wall thickness is 0.062 inches. The ten percent depth of depression is 0.0062 inches, with a resulting wall thickness of 0.0558 inches. The 75 percent depth of depression is 0.0465 inches, with a resulting wall thickness of 0.0155 inches.

For a minimum hosel outside diameter of 0.250 inches, and a minimum hosel bore inside diameter of 0.200 inches, the resulting wall thickness is 0.025 inches. The ten percent depth of penetration is 0.0025 inches, with the resulting wall thickness of 0.0225 inches. For a 75 percent depth of depression of 0.0188 inches, the resulting wall thickness is 0.0062 inches.

With a hosel outside diameter of 0.250 inches and a hosel bore inside diameter of 0.225 inches, the resulting wall thickness is 0.0125 inches. For a ten percent depth of depression of 0.0013 inches, the resulting wall thickness is 0.0112 inches. For a 75 percent depth of depression of 0.0094 inches, the resulting wall thickness is 0.0031 inches.

For an exemplary embodiment of the present invention that utilizes fluted slots 116 whose major axis is aligned coaxial with the axis of the hosel 104 (i.e., the slots are formed vertically along the hosel outer wall surface 120), it is preferred that the total width of the flutes 116 (that is, the sum of the individual widths of each flute) range from approximately three percent to 75 percent of the circumference of the hosel 104. Thus, for a hosel 104 having an outer diameter of 1.250 inches, the circumference is 3.927 inches. The three percent width coverage of the circumference equals 0.1178 inches. The 75 percent circumference coverage equals 2.9453 inches. For a typical hosel outside diameter of 0.500 inches, the resulting circumference is 1.5708 inches. The three percent circumference coverage is 0.0471 inches, while the 75 percent circumference coverage is 1.1781 inches. Finally, for a minimum hosel outside diameter of 0.250 inches, the resulting circumference is 0.7854 inches. The three percent circumference coverage is 0.0236 inches, while the 75 percent circumference coverage is 0.5891 inches.

The present invention contemplates an exemplary length of the hosel 104 (as defined between the two phantom lines 164, 168 of FIGS. 2 and 3) as being in the range of from 0.1 inches to a maximum of 2.5 inches, with a typical value being, without limitation, 1.5 inches. Given the maximum hosel outside diameter of 1.250 inches and a circumference of 3.927 inches, with a hosel length of 0.1 inches the hosel outer surface area is 0.3927 square inches. A three percent area coverage equals 0.01178 square inches, while a 75 percent coverage equals 0.2945 square inches. With a hosel length of 2.5 inches, the area of the hosel is 9.8175 square inches. The three percent coverage equals 0.2945 square inches, while the 75 percent coverage equals 7.3631 square inches. With a typical hosel length of 1.5 inches, the area of the hosel is 5.8905 square inches. The three percent coverage is 0.1767 square inches, while the 75 percent coverage is 4.4179 square inches.

Next, with a hosel outside diameter of 0.500 inches and a circumference of 1.5708 inches, a hosel length of 0.1 inches yields an area of 0.1571 square inches. The three percent coverage is 0.0047 square inches, while the 75 percent coverage is 0.1178 square inches. For a hosel length of 2.5 inches, the area is 3.927 square inches. The three percent coverage is 0.1178 square inches, while the 75 percent coverage is 2.9452 square inches. Finally, for a typical hosel length of 1.5 inches, the resulting area is 2.3562 square inches. The three percent coverage is 0.0707 square inches, while the 75 percent coverage is 1.7672 square inches.

For a minimum hosel outside diameter of 0.250 inches and a circumference of 0.7854 inches, a hosel length of 0.1 inches yields an area of 0.0785 square inches. The three percent coverage is 0.0024 square inches, while the 75 percent coverage is 0.0589 square inches. For a hosel length of 2.5 inches, the area is 1.9635 square inches. The three percent coverage is 0.0589 square inches, while the 75 percent coverage is 1.4726 square inches. Finally, for a hosel length of 1.5 inches, the area is 1.1781 square inches. The three percent coverage is 0.0353 square inches, while the 75 percent coverage is 0.8836 square inches.

Figure 5:
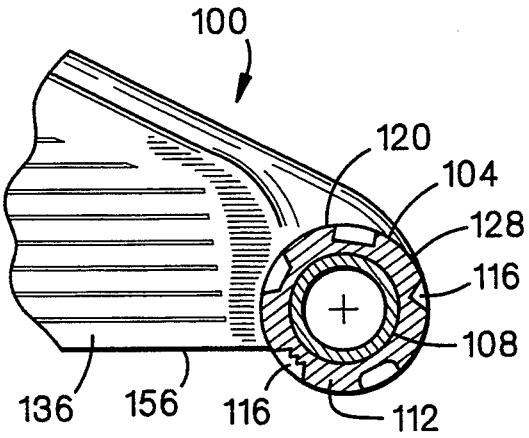
FIG. 5 is a cross-section view of the clubhead of FIG. 3 taken along the lines 4—4 of FIG. 3 and illustrating alternative shapes for the slots formed in the hosel of FIG. 3.

As mentioned hereinbefore, FIG. 4 illustrates the depressions 116 of FIG. 3 as having a circular cross section. However, it is to be understood that this is purely exemplary; other cross sectional shapes for any type of depression are illustrated in FIG. 5. For example, the depressions 116 may have a "V"-shape, a rectangular-shape, a "U"-shape, a "W"-shape, or an irregular polygon shape. The shape of the depression 116 is irrelevant for the broadest scope of the present invention. It suffice that the shaped depression chosen not be formed through the entire thickness of the hosel wall 112. The primary purpose for forming such depressions 116 in the hosel material beginning at the outer wall 112 and progressing toward the center of the hosel 104 is to remove unnecessary mass from the hosel 104. This allows the mass to be placed on other portions of the clubhead 100 where it is more beneficial. For example, a cavity-backed iron may utilize this unnecessary mass removed from the hosel 104 to better "perimeter weight" the clubhead 100.

Figure 6:
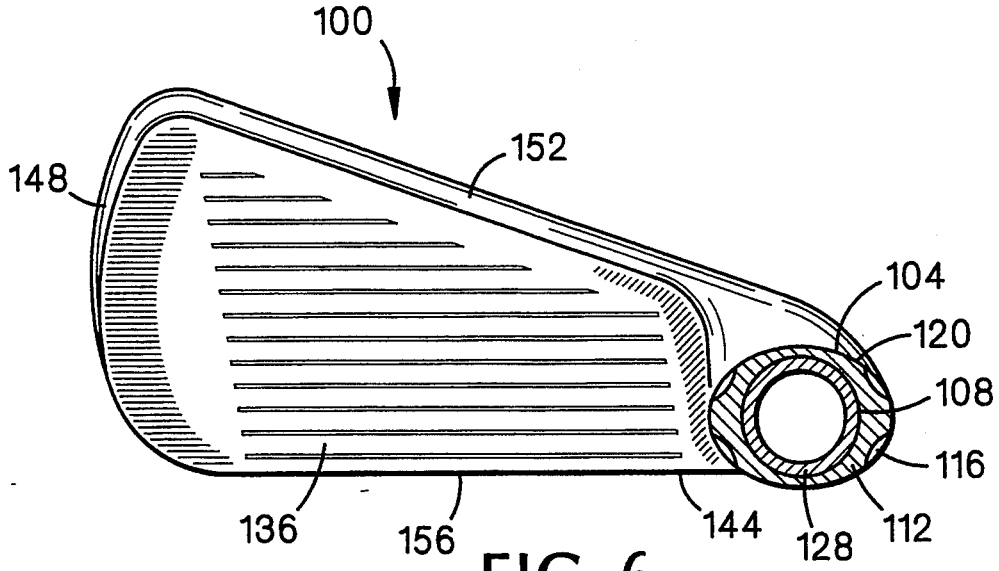
FIG. 6 is a cross-section view of an alternative embodiment of the hosel portion of the clubhead of FIG. 3 taken along the lines 4—4 of FIG. 3.

As described hereinbefore, the typical hosel 104 is cylindrical in shape throughout the majority of its length. However, it is to be understood that the hosel 104 may instead by of other shapes, such as elliptical, as seen in FIG. 6. FIG. 6 is a similar cross-section view as that illustrated in FIG. 4, except that FIG. 5 illustrates an elliptical hosel 104. The major axis of the ellipse is parallel to the longitudinal plane of the clubface 136. That is, the major axis of the ellipse is parallel to the grooves 140 formed on the clubface 136. The minor axis of the ellipse is parallel to the desired line of flight of the ball leaving the clubface 136. The preferred range of depth of each depression of the wall thickness of from 10 percent to 75 percent is equally applicable to the elliptical hosel.

It is to be understood that the locations on the hosel wall 112 of the depressions 116 are purely exemplary. The depressions 116 may be formed with any desired size and placement on the outer hosel wall material 112, in light of the teachings herein. It suffice for the present invention that one or more depressions 116 be formed in the hosel wall material 112 to a depth such that each depression 116 does not degrade the integrity of the interface of the shaft 128 within the bore hole 108 by forming the depressions 116 clear through the hosel wall material 112. It is to be further understood that the fluted slot shape of the depressions 116 is also purely exemplary. Other shapes may be used, without limitation, in light of the teachings herein.

Figure 7:
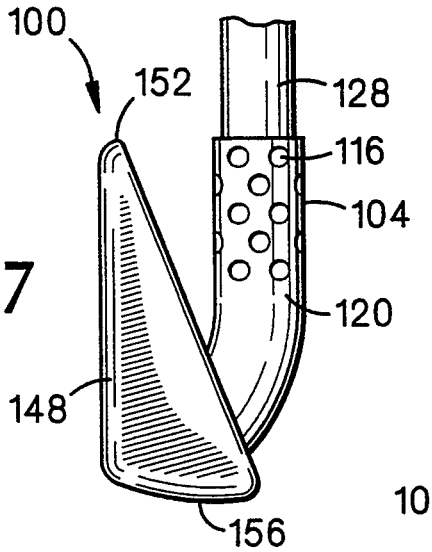
FIG. 7 is a toe-end view of a clubhead having a hosel portion with depressions formed therein in accordance with an alternative embodiment of the present invention.

For example, FIG. 7 illustrates a toe-end view of a clubhead 100 similar to that in FIG. 3, with the exception that a plurality of hemispherical "dots" 116 are formed in the hosel wall material 112. The "dots" 116 are formed in five "rows" encircling the circumference of the hosel 104. The dots 116 are shown staggered between rows. However, it is to be understood that such placement of the dots 116 is purely exemplary and is shown as such without limitation. In a similar manner to the fluted slots 116 described hereinbefore, the dots 116 may be formed by known methods of machining; for example, milling the depressions 116 out of the outer hosel wall material 112. The numerical ranges for depth of depression, surface area coverage, etc. described hereinbefore with respect to slots are equally applicable to dots, or any other shape or depression described herein or hereinafter contemplated. Further, regardless of the shape of the depression 116, the preferred percent range of from 10 percent to 75 percent of depth of the hosel wall 112 is desirable.

Figure 8:
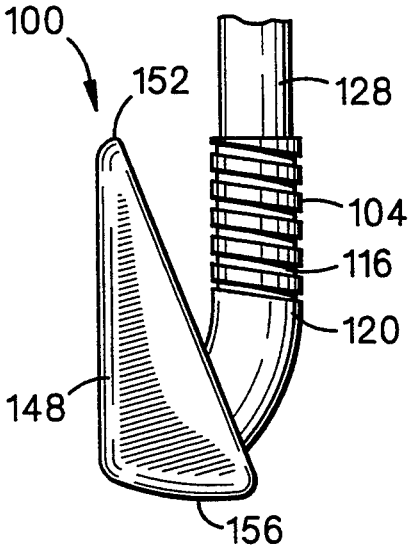
FIG. 8 is a toe-end view of a clubhead having a hosel with a portion of the hosel material removed in accordance with yet another alternative embodiment of the present invention.
Figure 9:
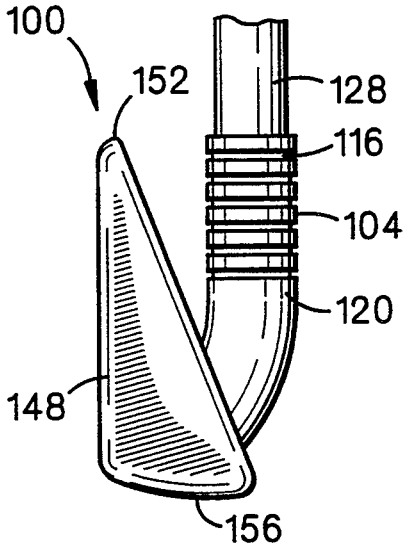
FIG. 9 is a toe-end view of a clubhead having a hosel with a portion of the hosel material removed in accordance with still another embodiment of the present invention.

FIGS. 8 and 9 illustrate further alternative embodiments of the present invention in which various shapes of depressions 116 are formed in the hosel outer wall material 112. In these and in the foregoing exemplary embodiments of the present invention, the depressions 116 are always formed such that they do not exceed the entire depth of thickness of the hosel wall material 112. FIG. 8 illustrates a toe-end view of the clubhead 100 with a hosel 104 having a continuous spiral depression 116 formed in the hosel outer wall material 112. FIG. 9, on the other hand, illustrates the hosel 104 having a series of circular "grooves" or channels 116 formed in the hosel wall material 112.

Figure 10:
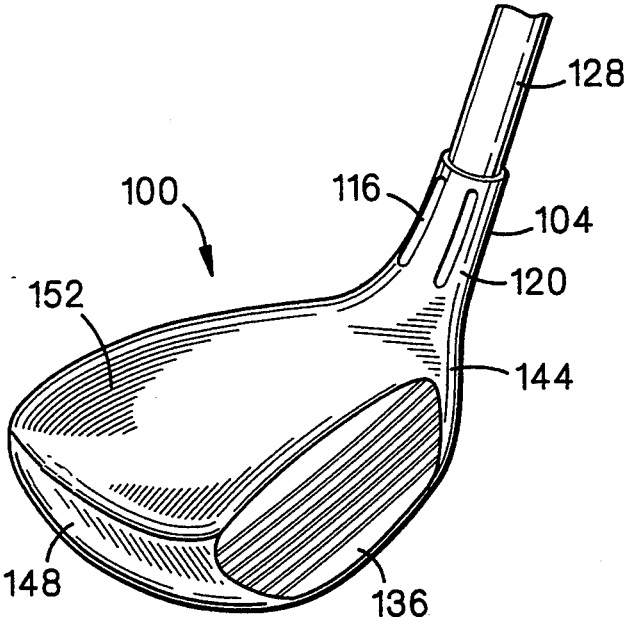
FIG. 10 is a perspective view of a clubhead of a "wood"-type golf club having a hosel portion with slots formed in the hosel in accordance with the present invention.

It is to be understood that the invention is not limited to the aforementioned "iron"-type of golf club 124. The present invention may be utilized on a hosel 104 which is integral with the head 100 of other types of golf clubs 124. For example, FIG. 10 illustrates a perspective view of a head 100 of a "wood"-type golf club 124; specifically, that of the "metal wood"-type of club 124. In a similar manner to the clubhead 100 of FIGS. 1–9, the hosel 104 of the metal wood clubhead 100 has a bore hole 108 formed in a portion of the hosel 104 for receiving and securing a shaft 128 of the club therewithin. FIG. 10 illustrates the hosel outer wall 112 as having a plurality of fluted slots 116 formed therein in a similar manner to that illustrated in FIG. 3. Again, the purpose of such slots 116 is to remove unnecessary and undesirable weight from the hosel 104 and redistribute such weight to the clubhead 100 where it is more beneficial to the performance to the golf club 124. However, any shape of depression 116 may be formed in the hosel 104 of the wood-type club 124, in light of the teachings herein.

Figure 11:
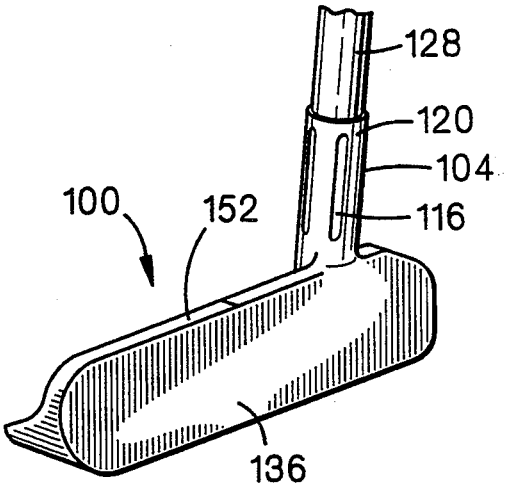
FIG. 11 is a perspective view of a clubhead for a "putter"-type golf club having a hosel with slots formed in the hosel in accordance with the present invention.

FIG. 11 illustrates in perspective the head 100 of a "putter"-type of golf club 124 having a plurality of fluted slots 116, similar to those of FIGS. 3 and 10, formed in the hosel 104 of the putter clubhead 100. In contrast to the clubhead 100 for the iron or wood golf clubs 124 described hereinbefore, the hosel 104 is not required by USGA rules to emanate from (i.e., rise up from) the heel 144 of the clubhead 100. Instead, although not shown in every instance, the hosel 104 may rise up from the toe 148 of the clubhead 100, or from some point between the heel 144 and toe 148.

With regard to the "wood" and "putter"-types of clubheads 100, all of the physical parameters (e.g., hosel outside diameter, bore hole I.D., etc.) and corresponding quantifiable numerical ranges given hereinbefore are equally applicable thereto.

As mentioned hereinbefore, the present invention is not limited to the specific shapes shown in the drawings herein. The depressions 116 formed in the hosel outer wall 112 may take on other shapes known or hereinafter contemplated. For example, the shapes may be in the form of stars, crescents, ovals, cylinders or any other shape. Further, the placement of the depressions 116 may be different then that shown herein. For example, the slots 116 may be formed at an orientation with respect to the hosel 104 other than longitudinally as illustrated in FIG. 3.

As illustrated in the figures, the internal bore hole 108 formed in the hosel 104 is cylindrical and is shown concentric to the cylindrical outer circumference of the hosel 104 as in FIG. 4. However, it is to be understood that instead the axis of the bore hole 108 may be eccentric to the axis of either the cylindrical hosel 104 of FIG. 4 or the elliptical hosel 104 of FIG. 6.

Figure 12:
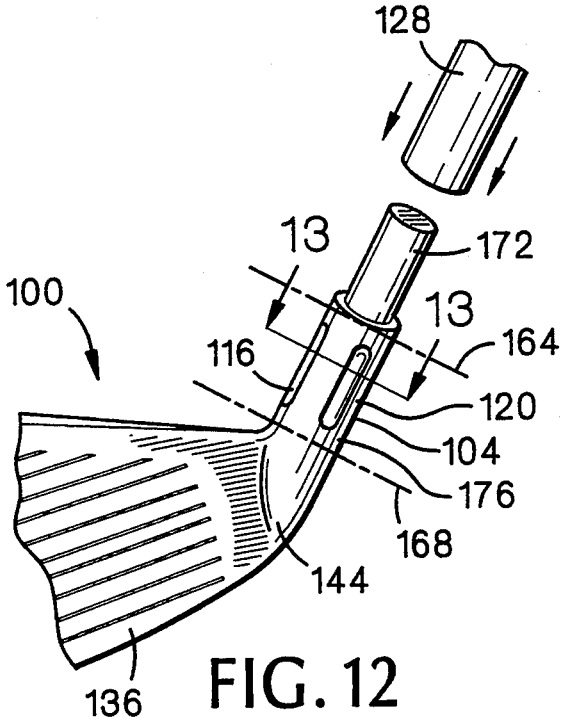
FIG. 12 is a close-up perspective view of an alternative embodiment of a "iron"-type golf club with a hosel having the depressions formed therein according to the present invention.
Figure 13:
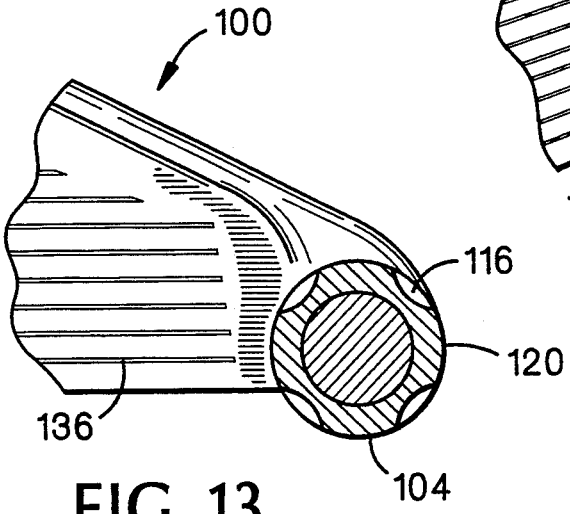
FIG. 13 is a cross-section view of the clubhead of FIG. 12 taken along the lines 13—13 of FIG. 12.

Further, the invention has been described for use with a hosel 104 having an internal bore hole 108. As such, the shaft 128 of the golf club 124 is inserted into the bore hole 108. However, it is to be understood that the depressions 116 may be utilized on a hosel 104 in which the shaft 128 instead fits over a solid "male" portion 172 of the hosel 104, as illustrated in FIGS. 12, 13. That is, the hosel 104 of FIGS. 12, 13 has a first portion 176 that may be generally cylindrical, elliptical or other form in shape, into which the depressions 116 of the present invention are formed. Integral with and disposed above the first or lower hosel portion 176 is a second "male" portion 172, generally cylindrical in shape and of a diameter smaller than that of the first portion 176. The second portion 172 rises to a predetermined distance above the top of the first hosel portion 176. No bore hole is formed in either the first or second hosel portions 176, 172, in contrast to the preferred embodiment described hereinbefore with respect to FIGS. 1–11. Instead, the shaft 128 has an internal bore hole (not shown) that fits over the second "male" portion 172 of the hosel 104 (as indicated by the directional arrowheads) for securing the shaft to hosel by, e.g., adhesives.

In this alternative"shaft-over-hosel" design illustrated in FIGS. 12, 13, the clubhead 100 is for an "iron"-type of golf club 124, similar to that of FIGS. 1–8. However, it is to be understood that the "shaft-over-hosel" design may be utilized on male hosels formed on either "wood" or "putter"-type golf clubs 124 respectively, of the type illustrated in FIGS. 10 and 11.

Further, the numerical quantities described earlier with respect to the embodiments of FIGS. 1–11 and with regard to the physical parameters of hosel outside diameter, depth of depression, hosel circumference, hosel length, hosel surface area, and percent coverage of hosel surface area by the depressions are equally applicable to the "shaft-over-hosel" design of FIGS. 12 and 13. In that embodiment, however, the hosel length is defined only with respect to the first hosel portion 176, as illustrated by the phantom lines 164, 168 of FIG. 12. Also, since there is no bore hole, the depth of depression 116 is understood to be the depth of penetration of the entire thickness of the hosel 104.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. A head portion of a golf club, comprising:

a. a striking face;

b. a heel;

c. a toe;

d. a sole; and e. a hosel having a bore formed at least a portion of the way through a material that constitutes the hosel wherein a hosel wall continuously surrounds the bore, the hosel wall having a portion of the wall material removed in the form of at least one depression beginning at an outer surface of the hosel wall and extending inward toward a center axis of the hosel, each depression being formed in the hosel wall at a depth of thickness of the hosel wall that is less than the entire thickness of the hosel wall, the depth of each depression being a maximum distance that the depression achieves as measured from the hosel wall outer surface, the depth of each depression being in the range of from ten percent of the hosel wall thickness to 75 percent of the hosel wall thickness, wherein a ten percent depth of each depression ranges from 0.0013 inches for a minimum hosel wall thickness of 0.0125 inches to 0.0525 inches for a maximum hosel wall thickness of 0.525 inches, wherein a 75 percent depth of each depression ranges from 0.0094 inches for a minimum hosel wall thickness of 0.0125 inches to 0.3938 inches for a maximum hosel wall thickness of 0.525 inches.

2. The head portion of the golf club of claim 1, wherein each depression encompasses a portion of a surface area of the outer surface of the hosel wall along a length of the hosel, a sum total of the surface area of the hosel wall outer surface covered by all of the depressions being in the range of from three percent to 75 percent.

3. The head portion of the golf club of claim 1, wherein the hosel has a cylindrical cross-sectional shape.

4. The head portion of the golf club of claim 1, wherein the hosel has an elliptical cross-sectional shape.

5. The head portion of the golf club of claim 1, wherein the bore hole has a cylindrical cross-sectional shape.

6. The head portion of the golf club of claim 1, wherein the head portion comprises an "iron"-type head.

7. The head portion of the golf club of claim 1, wherein the head portion comprises a "wood"-type head.

8. The head portion of the golf club of claim 1, wherein the head portion comprises a "putter"-type head.

9. The head portion of the golf club of claim 1, wherein an outside diameter of the hosel is in the range of from 0.250 inches to 1.250 inches.

10. The head portion of the golf club of claim 1, wherein a diameter of the bore hole is in the range of from 0.200 inches to 0.700 inches.

11. The head portion of the golf club of claim 1, wherein a thickness of the hosel wall is in the range of from 0.0125 inches to 0.525 inches.

12. The head portion of the golf club of claim 1, wherein a length of the hosel is in the range of from 0.1 inches to 2.5 inches, an outside diameter of the hosel is in the range of from 0.250 inches to 1.250 inches; with a hosel length of 0.1 inches a hosel wall outer surface area ranges from 0.0785 square inches to 0.3927 square inches for a corresponding hosel outside diameter of from 0.250 inches to 1.250 inches, respectively; with a hosel length of 2.5 inches, the hosel wall outer surface area ranges from 1.9635 square inches to 9.8175 square inches for a corresponding hosel outside diameter of from 0.250 inches to 1.250 inches, respectively.

13. The head portion of the golf club of claim 12, wherein a subtotal of the hosel wall outer surface area covered by all of the depressions is in the range of from three percent to 75 percent; with a hosel length of 0.1 inches the three percent hosel wall outer surface area coverage ranges from 0.0024 square inches to 0.01178 square inches, while the 75 percent hosel wall surface area coverage ranges from 0.0589 square inches to 0.2945 square inches; with a hosel length of 2.5 inches the three percent hosel wall outer surface area coverage ranges from 0.0589 square inches to 0.2945 square inches, while the 75 percent hosel wall surface area coverage ranges from 1.4726 square inches to 7.3631 square inches.

14. A head portion of a golf club, comprising:

a. a striking face;

b. a heel;

c. a toe;

d. a sole; and e. a hosel having at least one depression formed in the hosel beginning at an outer surface of the hosel wall and extending inward toward a center axis of the hosel, a depth of each depression being a maximum distance that the depression achieves inward toward the center axis of the hosel as measured from an outer surface of the hosel, the depth of each depression being in the range of from ten percent to 75 percent of the thickness of the hosel, wherein a length of the hosel is in the range of from 0.1 inches to 2.5 inches, an outside diameter of the hosel is in the range of from 0.250 inches to 1.250 inches; with a hosel length of 0.1 inches a hosel wall outer surface area ranges from 0.0785 square inches to 0.3927 square inches for a corresponding hosel outside diameter of from 0.250 inches to 1.250 inches, respectively; with a hosel length of 2.5 inches, the hosel wall outer surface area ranges from 1.9635 square inches to 9.8175 square inches for a corresponding hosel outside diameter of from 0.250 inches to 1.250 inches, respectively.

15. The head portion of the golf club of claim 14, wherein an outside diameter of the hosel is in the range of from 0.250 inches to 1.250 inches.

16. The head portion of the golf club of claim 14, wherein each depression encompasses a portion of the surface area of the outer surface of the hosel along a length of the hosel, a sum total of the surface area of the hosel outer surface covered by all of the depressions being in the range of from three percent to 75 percent.

17. The head portion of the golf club of claim 14, wherein a subtotal of the hosel wall outer surface area covered by all of the depressions is in the range of from three percent to 75 percent; with a hosel length of 0.1 inches the three percent hosel wall outer surface area coverage ranges from 0.0024 square inches to 0.01178 square inches, while the 75 percent hosel wall surface area coverage ranges from 0.0589 square inches to 0.2945 square inches; with a hosel length of 2.5 inches the three percent hosel wall outer surface area coverage ranges from 0.0589 square inches to 0.2945 square inches, while the 75 percent hosel wall surface area coverage ranges from 1.4726 square inches to 7.3631 square inches.

18. The head portion of the golf club of claim 14, wherein the head portion comprises an "iron"-type head.

* * * * *

Disclaimer 5,395,109—Francis A. Fenton, Jr., Sarasota, Fla. GOLF CLUB HOSEL HAVING DEPRESSIONS FORMED THEREIN. Patent dated March 7, 1995. Disclaimer filed Apr. 30, 1997, by the assignee, Fenton Golf Liquidating Trust.

The term of this patent shall not extend beyond the expiration date of Pat. No. 5,324,033.

*(Official Gazette,* June 17, 1997)